US012193529B2

(12) United States Patent
Brown

(10) Patent No.: US 12,193,529 B2
(45) Date of Patent: Jan. 14, 2025

(54) TORSO PROTECTION APPARATUS

(71) Applicant: Douglas Edward Brown, Trenton, MI (US)

(72) Inventor: Douglas Edward Brown, Trenton, MI (US)

( * ) Notice: Subject to any disclaimer, the term of this patent is extended or adjusted under 35 U.S.C. 154(b) by 48 days.

(21) Appl. No.: 18/195,971

(22) Filed: May 11, 2023

(65) Prior Publication Data

US 2023/0276871 A1 Sep. 7, 2023

Related U.S. Application Data

(60) Provisional application No. 63/405,231, filed on Sep. 9, 2022.

(51) Int. Cl.
*A41D 13/05* (2006.01)

(52) U.S. Cl.
CPC ..... *A41D 13/0512* (2013.01); *A41D 13/0568* (2013.01)

(58) Field of Classification Search
CPC . A63B 71/12; A63B 71/1291; A63B 2102/24; A41D 13/05; A41D 13/0531; A41D 13/0512; A41D 13/0506
See application file for complete search history.

(56) References Cited

U.S. PATENT DOCUMENTS

| | | | | |
|---|---|---|---|---|
| 7,987,526 | B2 * | 8/2011 | Durham | A41D 13/0153 2/467 |
| 8,082,602 | B2 * | 12/2011 | Crelinsten | A41D 13/05 2/92 |
| 9,078,477 | B2 * | 7/2015 | McAllister | A41D 13/0531 |
| 9,669,281 | B2 * | 6/2017 | Jourde | A63B 71/12 |
| 2013/0283511 | A1 * | 10/2013 | Diamond | A41D 13/0153 2/455 |
| 2015/0181950 | A1 * | 7/2015 | Skottheim | A41D 13/0512 2/463 |

* cited by examiner

*Primary Examiner* — Katherine M Moran
(74) *Attorney, Agent, or Firm* — Bullock Law; Stephen Bullock

(57) ABSTRACT

A torso protection apparatus with a shoulder harness, a shoulder and sleeve assembly, a midsection assembly, a plurality of protective pads, and a back including a plurality of pad housings. The plurality of pad housings includes a stretchable opening and is structured to removably accommodate the plurality of protective pads therein.

19 Claims, 9 Drawing Sheets

TORSO PROTECTION APPARATUS

FIELD OF THE INVENTION

The present invention relates to protective gear for extreme sports. In particular, the present invention relates to torso protection apparel with shielding inserts.

BACKGROUND

Extreme sports are adventure activities perceived as involving a high degree of risk. These activities often involve speed, height, and a high level of physical exertion. Between the years 2000 and 2011, it is estimated that over four million injuries were caused by extreme sports. Therefore, it is absolutely essential that participants in extreme sports be equipped with the proper protective apparel. However, most apparel is not breathable, is not stretchable to account for different types of movements, and does not specifically target vital organs and skeletal areas for protection. Therefore, there exists a need in the art for specialized apparel that is well ventilated, flexible, modularized, and specifically tailored to protect vital parts of the body during extreme sports. As such, there is a need for a torso protection apparatus as described herein.

SUMMARY OF THE INVENTION

Embodiments of the present invention are related to a torso protection apparatus with a shoulder harness, a shoulder and sleeve assembly, a midsection assembly, a plurality of protective pads, and a back including a plurality of pad housings. The plurality of pad housings includes a stretchable opening and is structured to removably accommodate the plurality of protective pads therein. The plurality of protective pads may be differently sized and shaped pads structured to cover vital organ and skeletal areas of the torso.

The shape of the plurality of pads may be at least one of a generally circular pad shape, a generally quadrilateral pad shape, a pentagonal pad shape, and a polygonal pad shape. The back and shoulder may include an upper row with a pair of quadrilateral diamond shaped pads and a pair of laterally oriented and generally rectangular pads flanking a centrally positioned circular upper spine guard pad. The back may include a medial row having a pair of curved lower scapula guards flanking a centrally positioned and diamond oriented quadrilateral pad. The back may also include a medial row with a plurality of longitudinally oriented generally quadrilateral pads with a pair of side guards, a pair of kidney guards, and a main spine guard.

The side guards may be sized the same as each other, but different than the kidney guards and the main spine guard may be the largest pad of any pad on the back. A lower row may include a plurality of laterally oriented generally quadrilateral pads structured to protect a wearer's lower back. Furthermore, a majority of a wearer's back torso may be covered by the apparatus and a majority of a wearer's front torso may not be covered by the apparatus.

Another embodiment of the invention may be a torso protection apparatus with a front, a shoulder harness, a shoulder and sleeve assembly, a torso strap, a midsection assembly, a plurality of protective pads, and a back having a plurality of pad housings. The midsection assembly may include a first belly strap, a second belly strap, and a third belly strap structured to overlap each other on a wearer's front. Furthermore, the plurality of pad housings may include a stretchable opening and may be structured to removably accommodate the plurality of protective pads therein.

In this embodiment, the torso strap may extend from the shoulder harness and may fit between the first belly strap and second belly strap. Furthermore, the first belly strap may extend from the right-side guard, the second belly strap may extend from the left-side guard, and the third belly strap may extend from the right-side guard.

The front may include the shoulder harness, the shoulder assembly, the midsection assembly, and a torso strap. A pair of shoulder attachment straps may extend from the shoulder guard to the shoulder harness and the sleeve assembly may include an arm runner and a bicep strap. The sleeve assembly may extend from the shoulder guard to the bicep strap, which may be structured to wrap around a wearer's bicep and secure to itself.

Another embodiment of the invention may include a torso protection apparatus with a shoulder harness, a shoulder and sleeve assembly, a midsection assembly, a plurality of protective pads, and a back comprising a plurality of pad housings. The plurality of pad housings may be structured to accommodate the plurality of protective pads therein, which may be differently sized and shaped pads to cover vital organ and skeletal areas of the torso. The apparatus may be structured to be removably engaged to itself at the shoulder harness, the sleeve assembly, and the midsection assembly. The back may include a wide upper portion, a medial inward taper, a straight lower torso section that extends around the sides to the front, and a bottom section that extends outward from the straight lower torso section. Furthermore, the back may include an upper spine guard that extends distally upward from the top edge of the back to cover a larger portion of a wearer's spine than the remaining back.

DETAILED DESCRIPTION OF THE INVENTION

The present invention will now be described in detail with reference to the accompanying drawings. The embodiment descriptions are illustrative and not intended to be limiting in any way. Other embodiments of the invention will readily suggest themselves to persons with ordinary skill in the art after having the benefit of this disclosure. Accordingly, the following embodiments are set forth without any loss of generality and without imposing limitation upon the claimed invention.

Directional terms such as "above" "below" "upper" "lower" and other like terms are used for the convenience of the reader in reference to the drawings. Additionally, the description may contain terminology to convey position, orientation, and direction without departing from the principles of the present invention. Such positional language should be taken in context of the represented drawings.

Quantitative terms such as "generally" "substantially" "mostly" and other like terms are used to mean that the referred object, characteristic, or quality constitutes a majority of the referenced subject. Likewise, use of the terms such as first and second do not necessarily designate a limitation of quantity. Such terms may be used as a method of describing the presence of at least one of the referenced elements or may provide a means of differentiating orientation. The meaning of any term within this description is dependent upon the context within which it is used, and the meaning may be expressly modified.

Figure 1A:
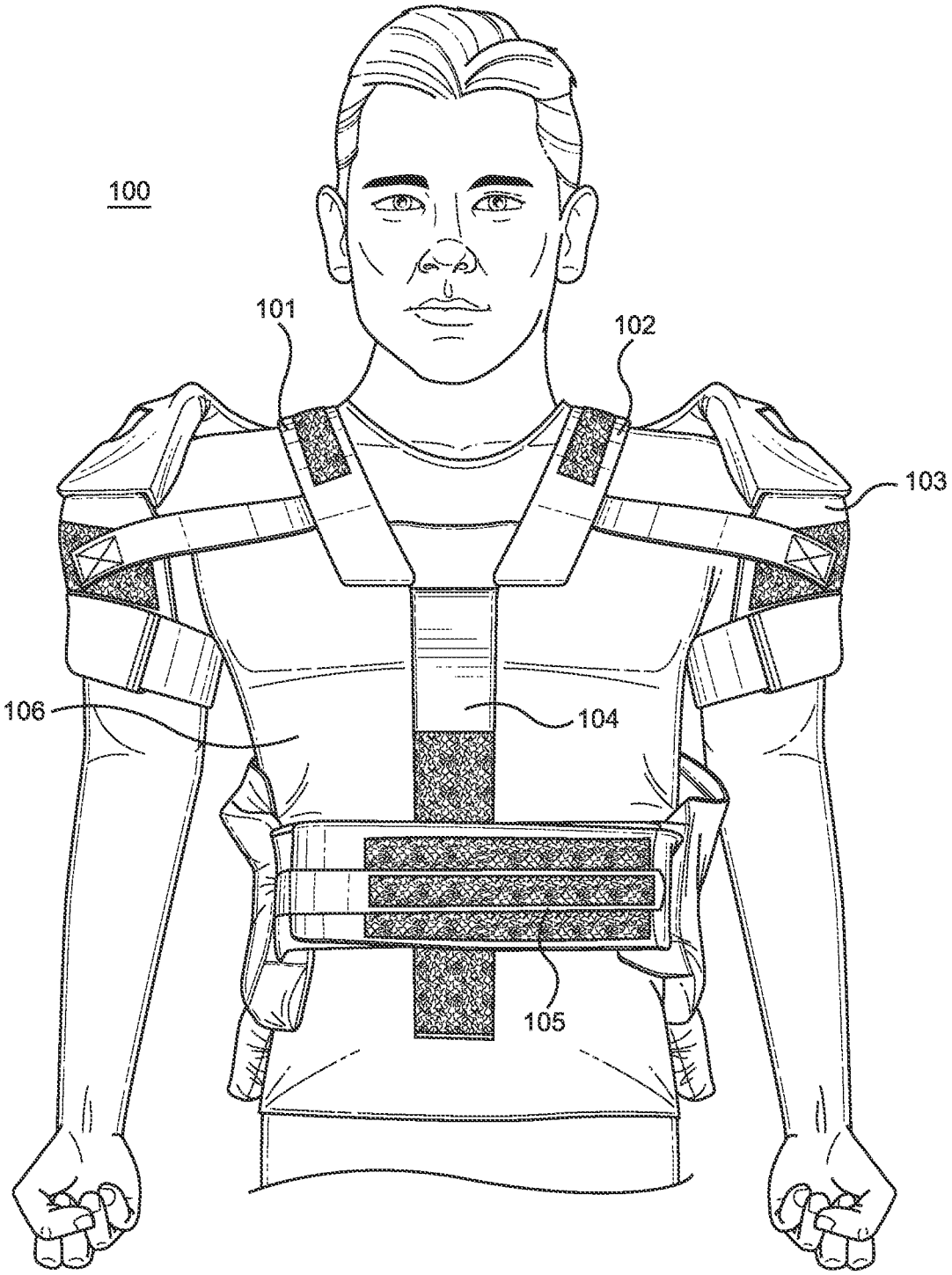
FIG. 1A is a front view of the torso protection apparatus according to an embodiment of the invention.
Figure 1B:
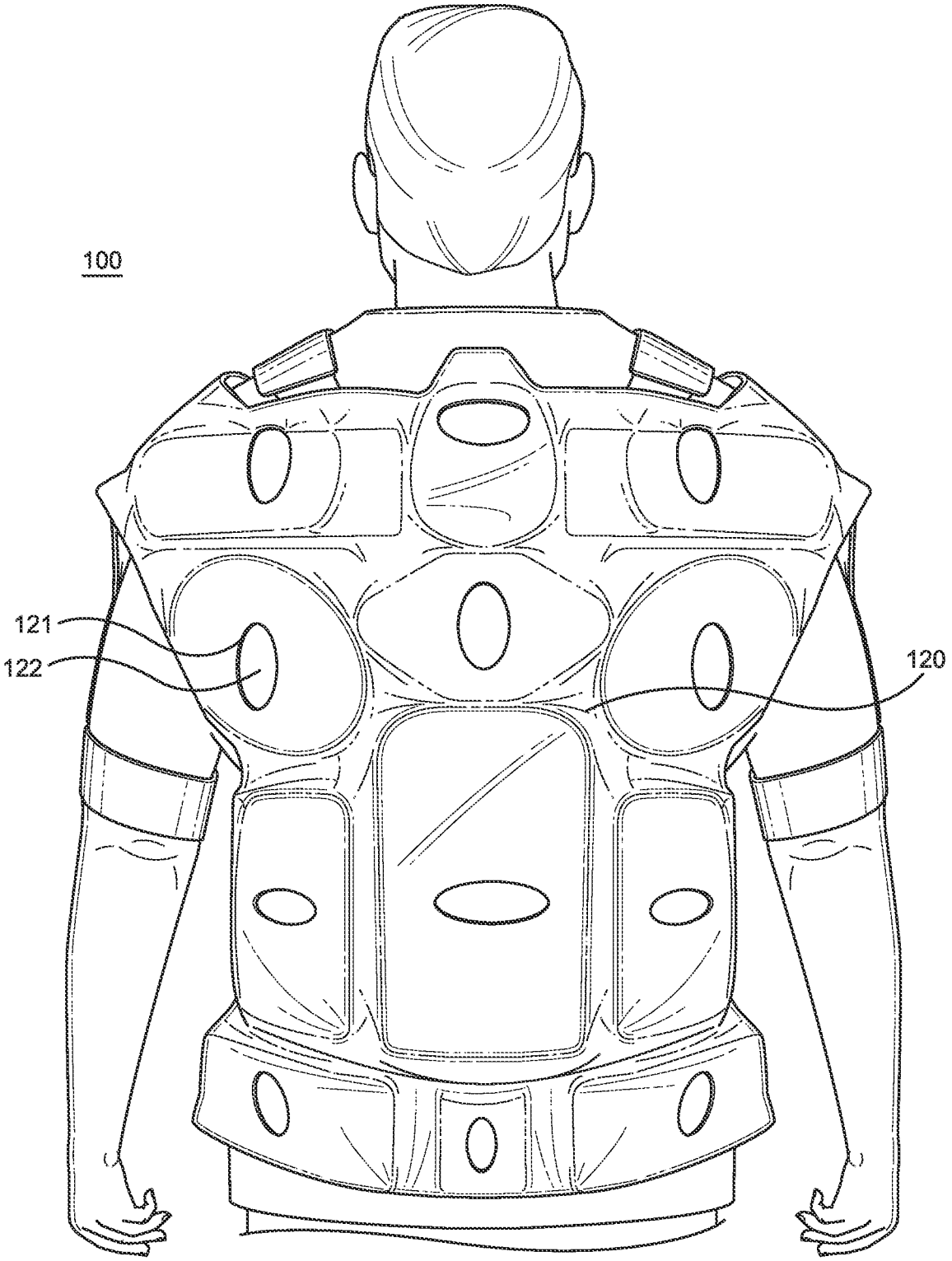
FIG. 1B is a back view of the torso protection apparatus illustrated in FIG. 1.

Referring now to FIGS. 1A and 1B, the torso protection apparatus 100, hereinafter referred to as the apparel or apparatus 100, may be protective clothing worn over the torso with a front 101 that is mostly exposed 106 and a covered back 120. The front 101 may include a shoulder harness 102, a shoulder and sleeve assembly 103, a front torso strap 104 and a midsection assembly 105. The back 120 may include a plurality of specifically and diversely shaped protective pads 122 within pad housings 121 covering a majority of a wearer's back torso.

Figure 2A:
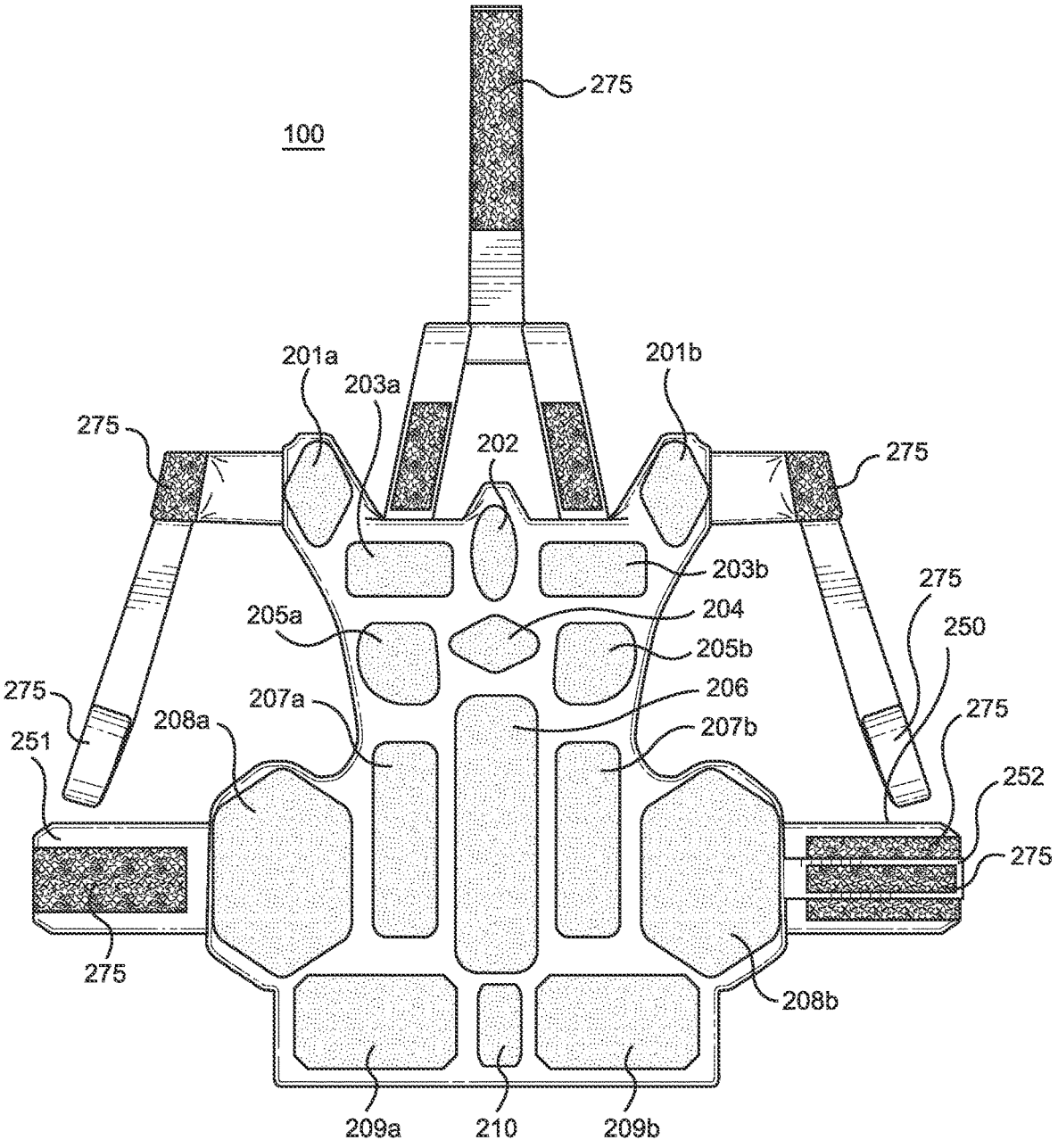
FIG. 2A is a back perspective view of the torso protection apparatus illustrated in FIG. 1 with exposed interior componentry.

FIG. 2A illustrates internal componentry of the apparel 100. In particular, it shows shapes and sizes of the protective pads 122 in one embodiment. Taken in light of FIG. 1B, this figure demonstrates that the plurality of protective pads 122 are differently sized and shaped pads specifically sized and structured to cover vital organ and skeletal areas of a wearer's torso. Hence, the shape of the plurality of protective pads 122 may include at least one of a generally circular pad shape, a generally quadrilateral pad shape, a pentagonal pad shape, and a polygonal pad shape.

The back and shoulder area may include an upper row with a pair of generally quadrilateral diamond shaped pads and a pair of laterally oriented and generally rectangular pads flanking a centrally positioned circular upper spine guard pad. As shown, the apparel 100 may include a pair of shoulder guards 201*a*, 201*b* positioned proximate an upper portion on opposing sides of the shoulder harness 102. In some embodiments, the shoulder guards 201*a*, 201*b* may resemble diamond shaped pads with rounded vertices.

Below the shoulder guards 201*a*, 201*b* and angled more centrally may be upper scapula guards 203*a*, 203*b*. The upper scapula guards 203*a*, 203*b* may resemble rectangular shaped pads with rounded vertices. The longitudinal length of the scapula guards 203*a*, 203*b* may run horizontally with respect to an upper and lower portion of the apparatus 100. In other words, the scapula guards 203*a*, 203*b* may be oriented to have their width measure longer than their height.

Between the upper scapula guards 203*a*, 203*b* may be an upper spine guard 202. The upper spine guard 202 may be oval shaped and may be positioned along a medial longitudinal axis of the apparel 100. The longitudinal length of the upper spine guard 202 may run vertically with respect to the apparel 100.

There may be a medial row including a pair of curved lower scapula guards 205*a*, 205*b* flanking a centrally positioned and generally diamond oriented and generally quadrilateral pad. This may be the medial spine guard 204 positioned below the upper spine guard 202 and centrally located along the medial longitudinal axis of the apparel 100. In some embodiments, the medial spine guard 204 may resemble a diamond with rounded vertices. Flanking either side of the medial spine guard 204 may be the pair of lower scapula guards 205*a*, 205*b*. A right-side lower scapula guard 205*b* may be shaped with more of a curved outer edge than its central edge. Furthermore, its upper edge may be longer in length than its lower edge. However, all vertices may be rounded. Similarly, a left-side lower scapula guard 205*a* may be shaped with more of a curved outer edge than its central edge. Its upper edge may be longer in length than its lower edge and all of its vertices may be rounded as well.

The back may also include a medial row with a plurality of longitudinally oriented generally quadrilateral pads including a pair of side guards 208*a*,208*b*, a pair of kidney guards 207*a*, 207*b*, and a main spine guard 206. The main spine guard 206 may be below the medial spine guard 204 positioned along the longitudinal axis of the apparel 100. The main spine guard 206 may resemble a rectangle with rounded vertices. The longitudinal length of the main spine guard 206 may run vertically. The width of the main spine guard 206 may be wider than the upper spine guard 202 and may measure closer to the width of the medial spine guard 204 at its widest point. The main spine guard 206 may be the longest pad within the apparel 100 and may be used to protect a majority of a wearer's spine.

Flanking either side of the main spine guard 206 may be a pair of kidney guards 207*a*, 207*b*. The kidney guards 207*a*, 207*b* may resemble rectangles with rounded vertices. They may include a longitudinal length encompassing 70-80% of the main spine guard 206 and may have their lateral axes aligned with the lateral axis of the main spine guard 206.

Flanking either side of the kidney guards 207*a*, 207*b* may be a pair of side guards 208*a*, 208*b*. The side guards 208*a*, 208*b* may resemble hexagons with rounded vertices. They may be sized to cover the sides of a wearer's waist. Each side guard 207*a*, 207*b* may be congruent, or sized the same, but different in size and shape than the kidney guards 207*a*, 207*b*.

The back may also include a lower row having a plurality of laterally oriented generally quadrilateral pads structured to protect a wearer's lower back. Below the side guards 208*a*, 208*b* and more centrally located may be a pair of gluteal guards 209*a*, 209*b*. The gluteal guards 209*a*, 209*b* may resemble rectangular shaped pads with rounded vertices. The longitudinal length of the gluteal guards 209*a*, 209*b* may run horizontally along a lower portion of the apparatus 100. In some embodiments the gluteal guards 209*a*, 209*b* may cover 5-10% of a wearer's gluteus maximus. However, one skilled in the art will appreciate that it may be more or less depending on need, preference, and circumstance.

Between the side guards 208*a*, 208*b* and below the main spine guard 206 may be a lower spine guard 210. The lower spine guard 210 may be positioned along the longitudinal axis of the apparel 100 at its bottom. The lower spine guard 210 may resemble a rectangle with rounded vertices. The longitudinal length of the lower spine guard 210 may run vertically along a vertical axis of the apparel 100. Its longitudinal length may be among the smaller if not the smallest of all of the protective pads 122. Its width may be between 25-50% the width of the main spine guard 204 and may be comparable to the longitudinal length of the upper spine guard 202.

The overall shape of the apparel 100 may be uniquely designed to accommodate the contours of a wearer's body as well as the specific shape of the protective pads 122. As shown, the shoulder harness 102 may be square with the torso strap 104 extending linearly therefrom. The sides may taper inwards from top to bottom between the shoulder guards 201*a*, 201*b* and the kidney guards 207*a*, 207*b* to mirror the latissimus dorsi muscles of a wearer's sides. The upper spine guard 202 may extend upwards from what otherwise would be a lateral upper portion of the apparel 100. Similarly, the shoulder guards 201*a*, 201*b* may extend upward from what would otherwise be a lateral shoulder strap. Furthermore, the material covering the side guards 208*a*, 208*b* may include an apex at their uppermost point. It may also taper inward from side edges of the side guards 208*a*, 208*b* at their lower portions. Likewise, material may extend downward to create a lower flap 307 covering a wearer's lower back that encompasses the gluteal guards 209*a*, 209*b* and the lower spine guard 210.

As previously mentioned, the apparel 100 may also include a midsection assembly 105. The midsection assembly 105 may include a first belly strap 250, a second belly strap 251, and a third belly strap 252. The first and second belly straps 251, 251 may resemble rectangles extending from the sides proximate the side guards 208*a*, 208*b*. They may be sized to fit around a wearer's waist and attach via hook and loop fasteners 275 to each other at a wearer's front stomach area. More specifically, the first belly strap 250 may extend from the right side of a wearer's waist and include hook and loop fasteners 275 along its outward facing surface. A user may then secure the torso strap 104 down from the shoulder harness 102 and position it overtop the first belly strap 250 securing it thereto by hook and loop fasteners 275. The second belly strap 251 may then fit overtop the torso strap 104 and first belly strap 250 and attach thereto via the hook and loop fasteners 275 on both the first belly strap 250 and the torso strap 104. The third belly strap 252 may extend from the right side of the apparel 100 proximate one end of the first belly strap 250 and may be designed to overlay the second belly strap 251 and attach thereto via hook and loop fasteners 275. Furthermore, much of the unconnected portions of the apparel may removably attached via hook and loop fasteners 275 as shown by FIG. 2A.

Overall, a majority of a wearer's back torso may be covered by the apparel 100 and a majority of a wearer's front torso may not be covered by the apparel 100. Furthermore, the apparatus may be structured to be removably engaged to itself at the shoulder harness 102, the shoulder and sleeve assembly 103 and the midsection assembly 105. Furthermore, the back 120 may include a wide upper portion, a medial inward taper, a straight lower torso section that extends around the sides to the front 102, and a bottom section that extends outward from the straight lower torso section. Additionally, the back may include an upper spine guard 202 that extends distally upward from the top edge of the back to cover a larger portion of a wearer's spine than the remaining back.

Figure 2B:
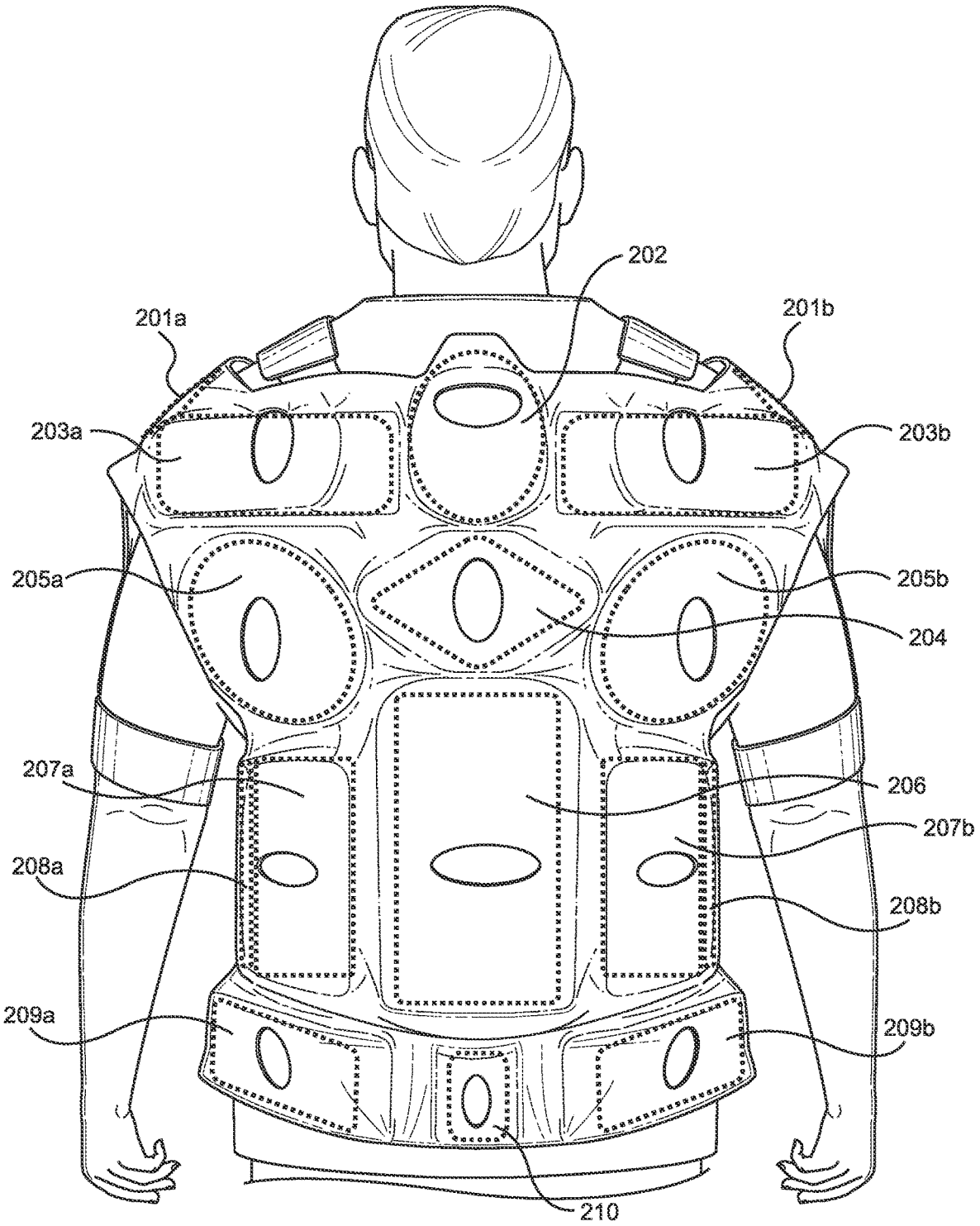
FIG. 2B is a demonstrative back view of componentry of the torso protection apparatus illustrated in FIG. 1.

FIG. 2B illustrates how the apparel 100 may stretch to fit over a wearer's back torso. It also illustrates the positioning of the protective pads 122 in relation to a wearer's anatomy. As named and described, the shoulder guards 201*a*, 201*b* may fit overtop a wearer's shoulders at an uppermost portion of their torso. The upper spine guard 202 may cover their upper spine and the shoulder guards 201*a*, 201*b* may cover a large portion of the wearer's upper shoulder and latissimus dorsi areas. The medial spine guard 204 may cover a middle portion of the spine and back and the lower scapula guards 205*a*, 205*b* may cover a large portion of the wearer's latissimus dorsi areas. The main spine guard 206 may cover a large portion of the wearer's middle lower back and spine. The kidney guards 207*a*, 207*b* may cover the lower portion of the back not enveloped by the main spine guard 206 and the side guards may cover the wearer's waist. The gluteal guards 209*a*, 209*b* may cover a wearer's lower back and a small portion of their buttocks, while the lower spine guard 210 may cover the lower middle section of a user's back.

Figure 3:
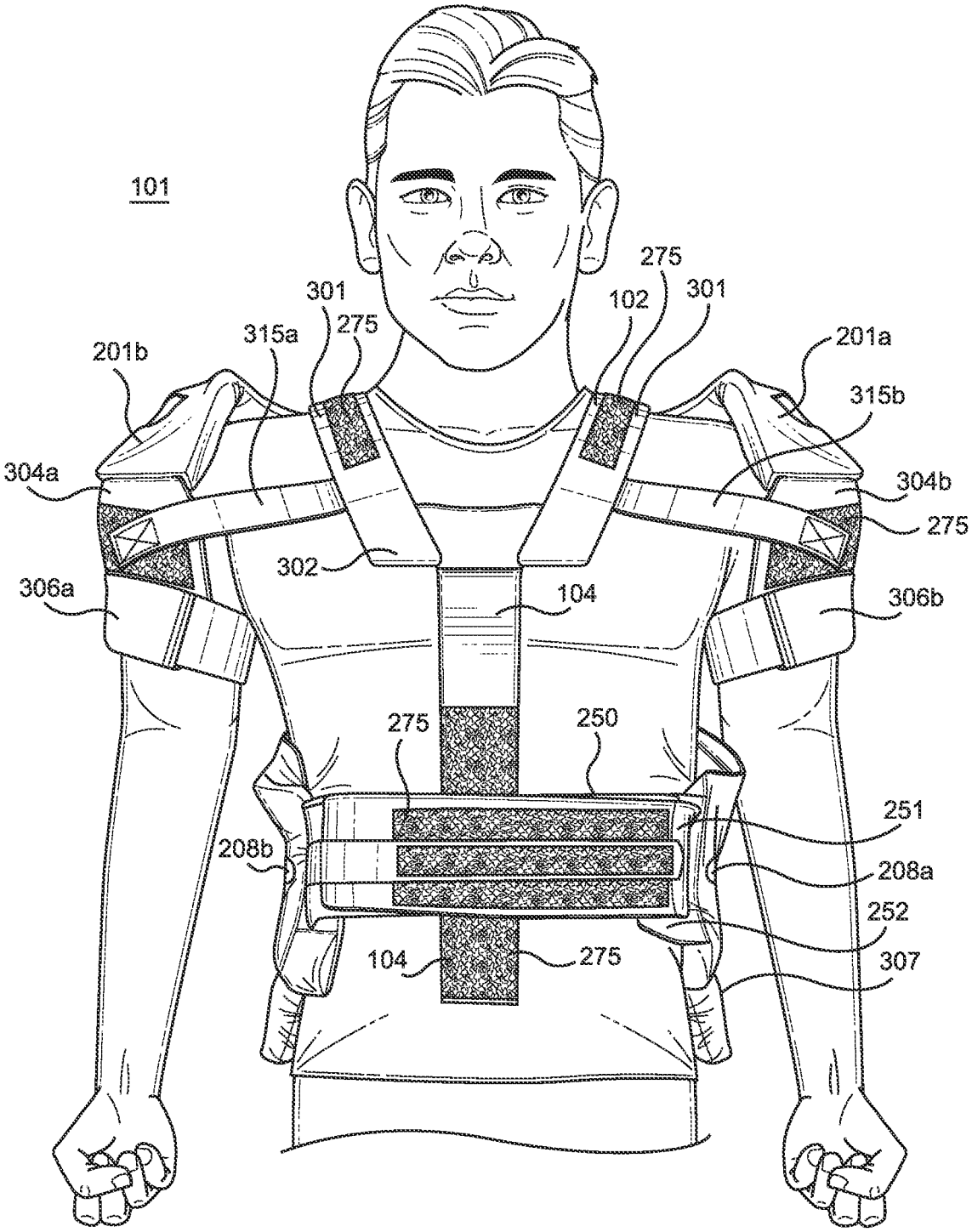
FIG. 3 is a front view of the torso protection apparatus illustrated in FIG. 1.

FIG. 3 illustrates the front 101 of the apparel 100. As shown, the shoulder harness 102 may include front-to-back vertical straps 301 that may fit overtop a wearer's clavicle extending from the back torso to the front torso. These front-to-back vertical straps 301 may be adjoined by the front lateral strap 302 extending laterally across a wearer's chest. Extending downward from the shoulder harness 102 may be a torso strap 104 designed to run down the center of a wearer's front torso and removably attach to the midsection assembly 105 via hook and loop fasteners 257.

The shoulder and sleeve assemblies 103 may include the shoulder guards 201*a*, 201*b*, arm runners 304*a*, 304*b*, and bicep straps 306*a*, 306*b*. The bicep straps may wrap around a user's arm at their bicep region and attach to themselves via hook and loop fasteners 275. Furthermore, the shoulder and sleeve assemblies 103 may secure to the shoulder harness 102 via shoulder attachment straps 315*a*, 315*b* allowing for a more stable and secure fit of the apparel 100 at the front 101.

As previously mentioned, the midsection assembly 105 may include the first belly strap 250 wrapping around a wearer's stomach area from the right side. A user may then secure the torso strap 104 down from the shoulder harness 102 and position it overtop the first belly strap 250 securing it thereto by hook and loop fasteners 275. The second belly strap 251 may then extend from a wearer's left side and secure overtop the first belly strap 250 and torso strap via hook and loop fasteners 275 on the outer surfaces thereof. The third belly strap 252 may then secure the other two belly straps 250, 251 by extending from a wearer's right side and fitting overtop the second belly strap 251. Also featured in this figure is the open front 106 allowing for easier heat dissipation during wear.

Figure 4:
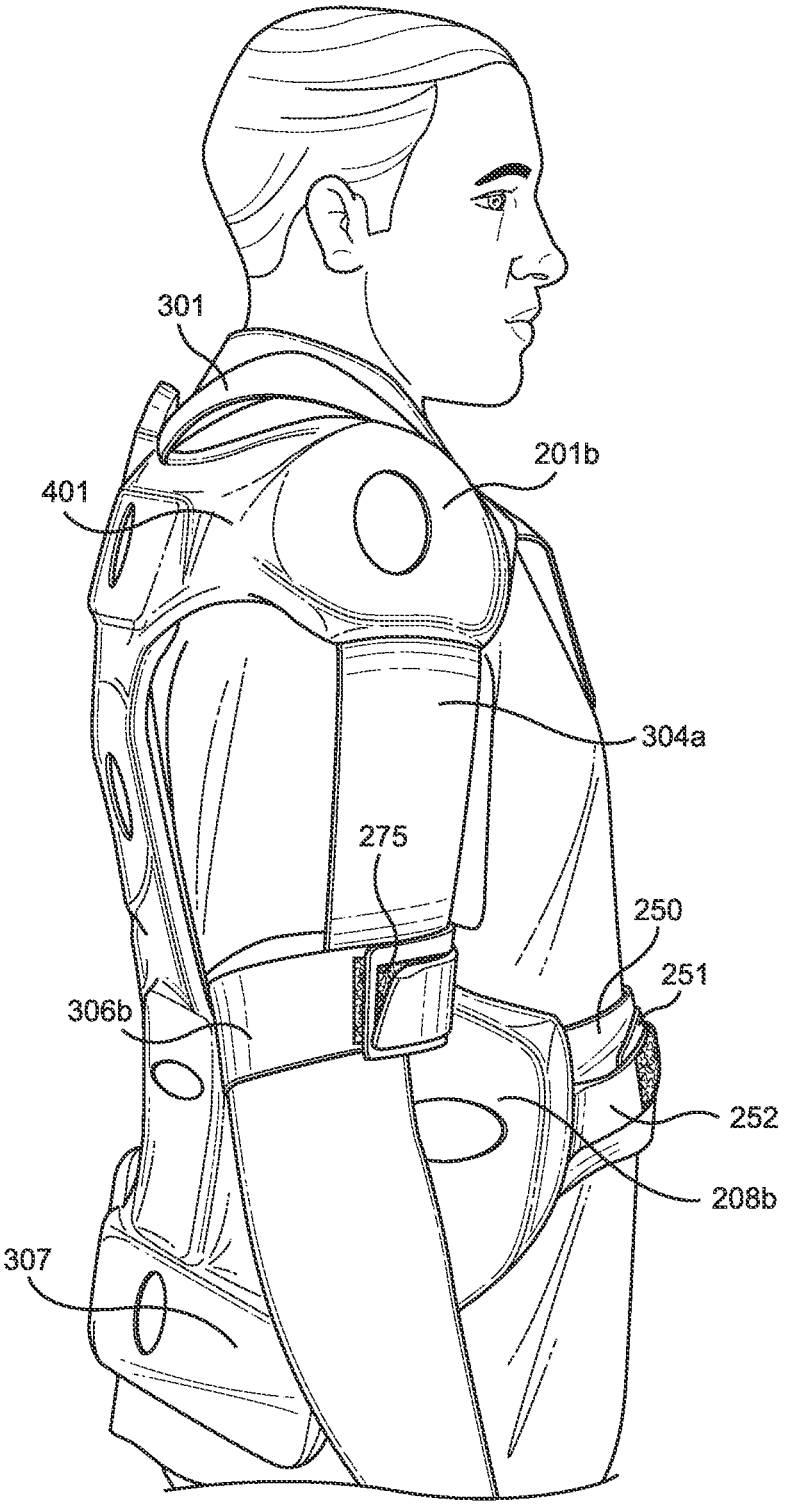
FIG. 4 is a side view of the torso protection apparatus illustrated in FIG. 1.

FIG. 4 illustrates a side view of the apparel 100. As shown the front-to-back vertical strap may extend from the back 120 to the front 101. There may also be a transition strap 401 that extends from the back upper torso area proximate the shoulder guard 201*a*, 201*b*. Extending downward from the shoulder guard 201*a*, 201*b* area may be arm runners 304*a*, 304*b* to assist with stabilizing the shoulder sleeve assembly 103 and the front 101. The arm runners 304*a*, 304*b* and the shoulder sleeve assembly 103 may be further stabilized by the bicep straps 306*a*, 306*b*. As shown, the bicep straps 306*a*, 306*b* may wrap around a midsection of a wearer's arm and fasten onto itself. This may be achieved by hook and loop fasteners attached to opposing end surfaces of the bicep straps 302*a*, 306*b*.

Also shown in the figure is the structural relationship between the right side guard 208*b*, the first belly strap 250, the second belly strap 251 and the third belly strap 252. As demonstrated, the first belly strap 250 may extend from the area proximate the side guard 208*b*. The third belly strap 252 may be narrower than the first belly strap 250 and centrally located overtop. The second belly strap 252 may extend from the left side guard 208*a* area and fit between the first belly strap 251 and the third belly strap 252.

Figure 5B:
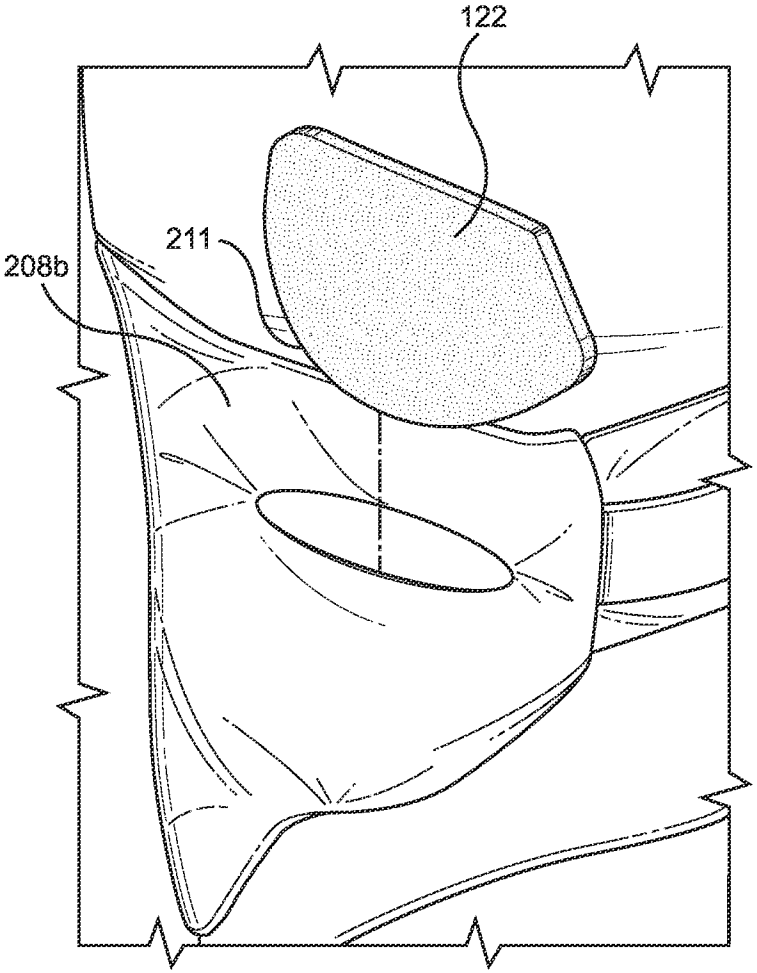
FIG. 5B is a demonstrative side segmented view of a component of the torso protection apparatus illustrated in FIG. 1.
Figure 5A:
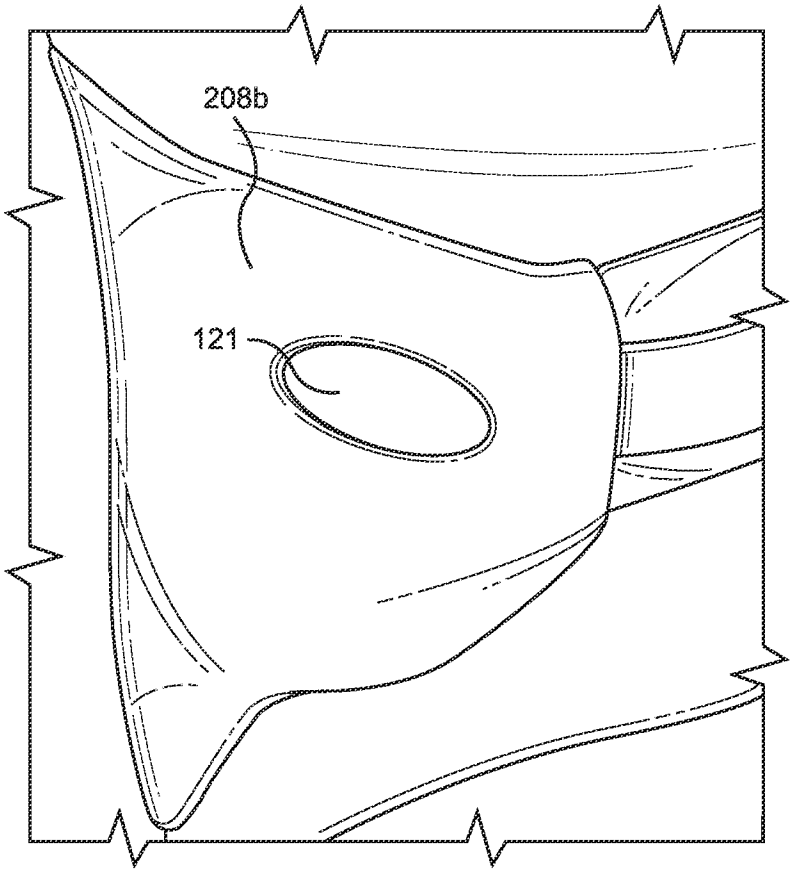
FIG. 5A is a side segmented view of a component of the torso protection apparatus illustrated in FIG. 1.
Figure 5C:
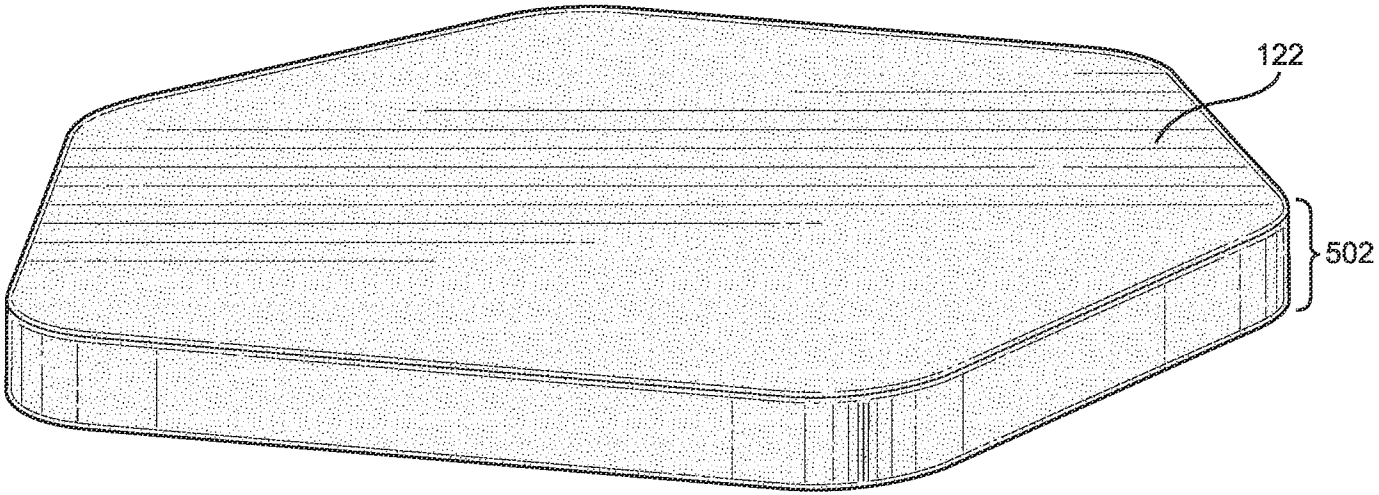
FIG. 5C is a perspective view of a component of the torso protection apparatus illustrated in FIG. 1.

FIGS. 5A through 5C take a closer look at the fitting between the pad housings 121 and the protective pads 121. By way of non-limiting example, a side guard 208*b* and its respective pad housing 121 is shown. The pad housing 121 may be uniquely sized and shaped to removably accommodate the unique size and shape of the protective pad 122. However, the material used in the apparel 100 may be stretchable to accommodate deviations in shape and size. Likewise, the pad housings 121 may include stretchable pocket seams 211 creating openings that may expand for insertion and removal of the protective pads 122, but contract after insertion. In fact, in some embodiments, the interior housing material may be webbing and the outer housing enclosure may be material such as spandex. This may allow for the aperture to stretch around the padding when being inserted and then restrict afterwards.

In other words, in some embodiments, the pads may be encased in two types of stretchable mesh material. The outer layer may be the thicker layer. The inner mesh may be a thinner layer. Therefore, there may be a first inner thin mesh layer, then the protective pad inserted overtop, then the thicker outer stretchable mesh layer. The mesh used in the apparel 100 may assist with heat dissipation as well.

FIG. 5C shows a protective pad 122 and the material that may be used in its construction. The protective pads 122 may be made from foam and may have a thickness of 0.25-0.50 inches. However, one skilled in the art will appreciate that the thickness may be larger or smaller depending on need, preference, and circumstance.

Figure 6B:
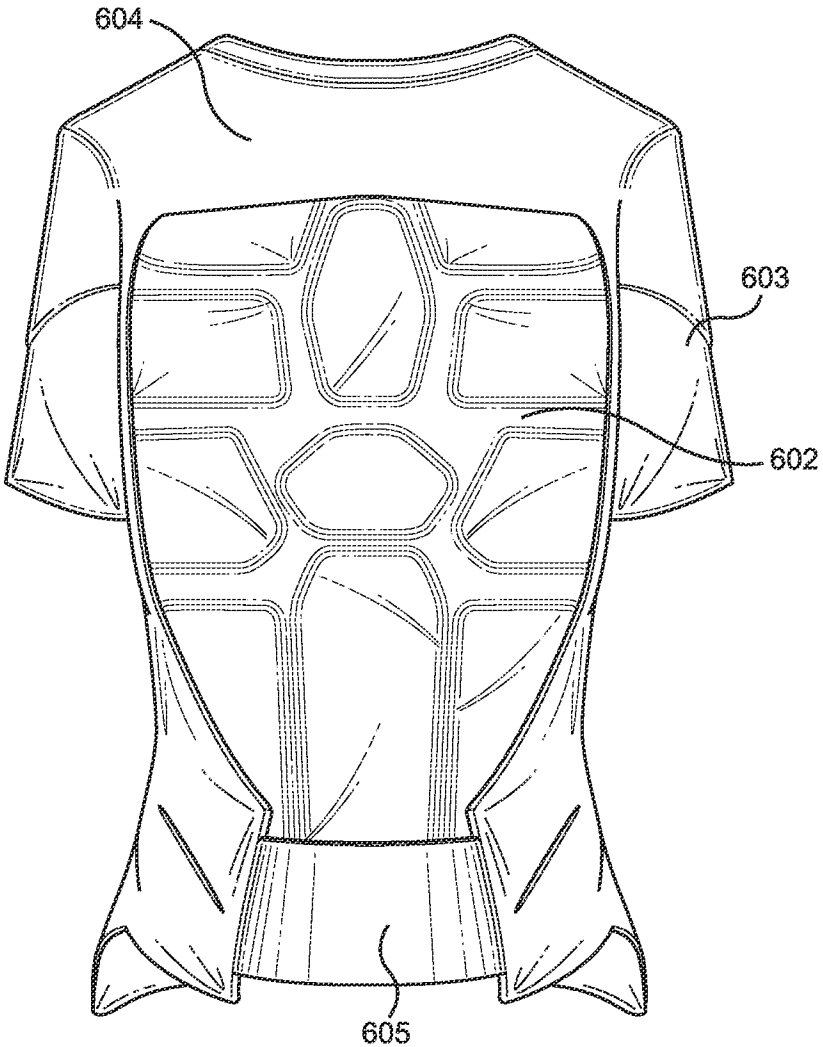
FIG. 6B is a front view of the embodiment of the torso protection apparatus in FIG. 6A.
Figure 6A:
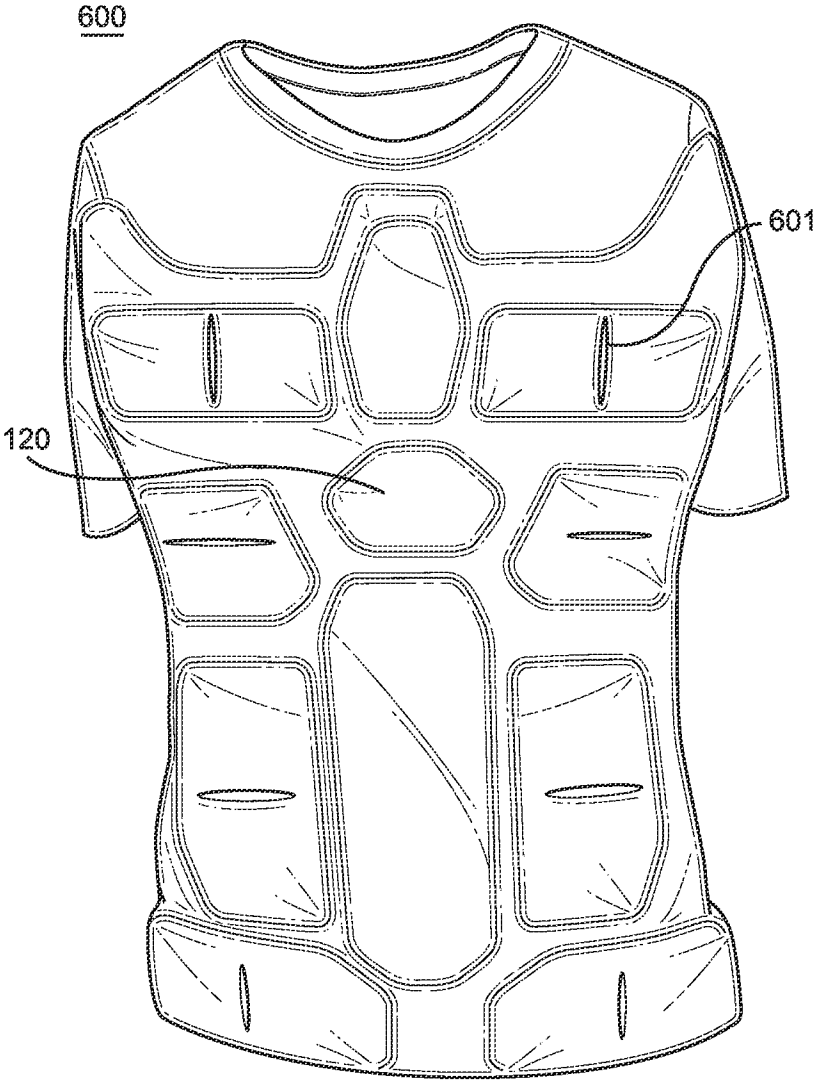
FIG. 6A is a back view of another embodiment of the torso protection apparatus.

FIGS. 6A and 6B illustrate another embodiment of the invention whereby the pad housings are enclosed 601. This may create a closed shirt with non-removable protective padding therein. The entire apparel 600 may be comprised of a mesh shirt with open front 602. The upper front torso area may be the upper portion of the mesh shirt along with intact sleeves 603. The midsection assembly 605 may be a combination of two or three straps and used similarly to the previous embodiment. However, in some embodiments, the midsection assembly 605 may be a single strap permanently attached to the rest of the apparel 600 so that the shirt may be slipped overtop a wearer's torso without having to secure any straps.

That which is claimed is:

1. A torso protection apparatus comprising:
a shoulder harness,
a shoulder and sleeve assembly,
a midsection assembly,
a plurality of protective pads including a medial row comprising a pair of curved lower scapula guards flanking a centrally positioned and diamond oriented quadrilateral pad; and
a back comprising a plurality of pad housings;
wherein the plurality of pad housings comprises a stretchable opening; and
wherein the plurality of pad housings is configured to removably accommodate the plurality of protective pads therein.

2. The torso protection apparatus of claim 1 wherein the plurality of protective pads are differently sized and shaped pads configured to cover vital organ and skeletal areas of the torso.

3. The torso protection apparatus of claim 1 wherein the shape of the plurality of pads includes at least one of a generally circular pad shape, a generally quadrilateral pad shape, a pentagonal pad shape, and a polygonal pad shape.

4. The torso protection apparatus of claim 1 wherein the back and a shoulder area comprise an upper row including a pair of quadrilateral diamond shaped pads, and a pair of laterally oriented and generally rectangular pads flanking a centrally positioned circular upper spine guard pad.

5. The torso protection apparatus of claim 1 wherein the back comprises a medial row comprising a plurality of longitudinally oriented generally quadrilateral pads including a pair of side guards, a pair of kidney guards, and a main spine guard.

6. The torso protection apparatus of claim 5 wherein the side guards are sized the same as each other, but different than the kidney guards; and wherein the main spine guard is the largest pad of any pad on the back.

7. The torso protection apparatus of claim 1 wherein the back comprises a lower row including a plurality of laterally oriented generally quadrilateral pads configured to protect a wearer's lower back.

8. The torso protection apparatus of claim 1 wherein the apparatus is configured to cover a majority of the wearer's back while leaving a majority of the wearer's torso uncovered.

9. A torso protection apparatus comprising:
a front,
a shoulder harness,
a shoulder and sleeve assembly,
a torso strap,
a midsection assembly,
a plurality of protective pads, and
a back comprising a plurality of pad housings;
wherein the midsection assembly includes a first belly strap, a second belly strap, and a third belly strap configured to overlap each other on a wearer's front;
wherein the plurality of pad housings comprises a stretchable opening; and
wherein the plurality of pad housings is configured to removably accommodate the plurality of protective pads therein.

10. The torso protection apparatus of claim 9 wherein the torso strap extends from the shoulder harness and is configured to fit between the first belly strap and second belly strap.

11. The torso protection apparatus of claim 9 wherein the first belly strap extends from a right-side guard, the second belly strap extends from a left-side guard, and the third belly strap extends from the right-side guard.

12. The torso protection apparatus of claim 9 wherein the front comprises the shoulder harness, the shoulder assembly, the midsection assembly, and the torso strap.

13. The torso protection apparatus of claim 9 further comprising a pair of shoulder attachment straps extending from a shoulder guard to the shoulder harness.

14. The torso protection apparatus of claim 9 wherein the sleeve assembly comprises an arm runner and a bicep strap.

15. The torso protection apparatus of claim 14 wherein the sleeve assembly extends from a shoulder guard to the bicep strap.

16. The torso protection apparatus of claim 14 wherein the bicep strap is configured to wrap around a wearer's bicep and secure to itself.

17. A torso protection apparatus comprising:
a shoulder harness,
a shoulder and sleeve assembly,
a midsection assembly,
a plurality of protective pads, and a back comprising a plurality of pad housings;

wherein the plurality of pad housings is configured to accommodate the plurality of protective pads therein;

wherein the plurality of protective pads are differently sized and shaped pads configured to cover vital organ and skeletal areas of the torso;

wherein the torso protection apparatus is configured to be removably engaged to itself at the shoulder harness, the sleeve assembly, and the midsection assembly; and wherein the midsection assembly includes a first belly strap, a second belly strap, and a third belly strap configured to overlap each other on a wearer's front.

18. The torso protection apparatus of claim 17 wherein the back comprises a wide upper portion, a medial inward taper, a straight lower torso section that extends around sides to the front, and a bottom section that extends outward from the straight lower torso section.

19. The torso protection apparatus of claim 17 wherein the back comprises an upper spine guard that extends distally upward from a top edge of the back to cover a larger portion of a wearer's spine than the remaining back.

* * * * *